US007381127B2

(12) United States Patent
Price

(10) Patent No.: US 7,381,127 B2
(45) Date of Patent: Jun. 3, 2008

(54) APPARATUS FOR TRANSFERRING HAZARDOUS MATERIAL

(75) Inventor: Robert G. Price, Wilmington, NC (US)

(73) Assignee: Flow Sciences, Inc., Leland, NC (US)

( * ) Notice: Subject to any disclaimer, the term of this patent is extended or adjusted under 35 U.S.C. 154(b) by 153 days.

(21) Appl. No.: 11/202,587

(22) Filed: Aug. 12, 2005

(65) Prior Publication Data

US 2007/0298701 A1 Dec. 27, 2007

(51) Int. Cl.
*B08B 15/02* (2006.01)
*B08B 15/00* (2006.01)

(52) U.S. Cl. ..... 454/56; 454/49; 454/63; 141/93; 141/97; 312/1

(58) Field of Classification Search ..... 454/49, 454/56, 57, 63, 65, 66, 67; 141/93, 383, 141/97; 312/1; 55/385.2
See application file for complete search history.

(56) References Cited

U.S. PATENT DOCUMENTS 3,145,858 A 8/1964 Helbig
3,217,630 A * 11/1965 Katzfey et al. ..... 454/62
3,875,853 A * 4/1975 Pielkenrood ..... 454/187
4,026,286 A * 5/1977 Trexler ..... 128/205.26
4,566,293 A * 1/1986 Arner et al. ..... 62/51.1
4,669,950 A 6/1987 St. Lawrence
4,920,768 A * 5/1990 Cares et al. ..... 68/18 R
5,205,699 A * 4/1993 Habicht ..... 414/420
5,257,957 A * 11/1993 Diccianni et al. ..... 454/57
5,263,521 A 11/1993 Brossard et al.
5,379,814 A * 1/1995 Posly ..... 141/351
5,735,321 A 4/1998 Martyn et al.
5,861,305 A * 1/1999 Silley et al. ..... 435/286.6
5,890,781 A * 4/1999 Ryder ..... 312/1
5,928,075 A * 7/1999 Miya et al. ..... 454/56
6,132,090 A 10/2000 Hashimoto
6,254,330 B1 7/2001 Steffen et al.
6,428,122 B1 * 8/2002 Henry et al. ..... 312/1
6,431,975 B1 * 8/2002 Ryan ..... 454/49
6,517,429 B1 * 2/2003 O'Connell et al. ..... 454/56
6,595,247 B1 7/2003 Landy et al.
6,779,567 B1 * 8/2004 Szatmary ..... 141/51
6,814,770 B2 * 11/2004 Lu et al. ..... 55/385.2
6,843,283 B2 1/2005 Dietrich

FOREIGN PATENT DOCUMENTS

GB 2109921 A * 6/1983

* cited by examiner

*Primary Examiner*—Steven B. McAllister
*Assistant Examiner*—Patrick F. O'Reilly, III
(74) *Attorney, Agent, or Firm*—MacCoro Mason PLLC

(57) ABSTRACT

An apparatus is described for transferring hazardous material between the interior of a container and the chamber of a fume hood having a port that includes a flexible enclosure with an upper surface, a lower surface and a side surface; a first conduit extending from the enclosure to connect to the port; a second conduit extending from the enclosure to connect with the container; and a pair of glove ports in the enclosure outer wall, including sleeved gloves extending into the enclosure, whereby the interior of the container and the chamber of the fume hood are accessible through the glove ports. The apparatus may also include means for supporting the enclosure in an open position above the container.

6 Claims, 2 Drawing Sheets

APPARATUS FOR TRANSFERRING HAZARDOUS MATERIAL

BACKGROUND OF THE INVENTION (1) Field of the Invention

The present invention relates to improved apparatus for use in transferring hazardous material between large containers and fume hoods or ventilated workstations, and in particular to an apparatus that is attachable to a fume hood and a large container permitting transfer of hazardous materials between the container and the interior of the fume hood without insertion of any part of the container into the fume hood or exposure of the operator to the hazardous material.

(2) Description of the Prior Art

Fume hoods or vented workstations are used in laboratories and other environments to manipulate materials that might generate noxious or dangerous gases or fumes without releasing the materials or components or fumes therefrom into the work environment. Generally, these fume hoods are comprised of an enclosure or chamber in which materials are handled, and means for drawing air through a front opening in the enclosure. The operator also uses this front opening as the means of access into the enclosure. The enclosure also includes an exhaust opening, frequently communicating with a filter, to remove contaminants from air exhausted from the chamber.

The fume hood is normally comprised of side and top walls, which may be of transparent material, such as PLEXIGLASS™ acrylic plastic sheet, or other clear plastic, a rear wall with an exhaust opening, and a planar bottom wall or floor. The front edges of the top, side and bottom walls may form an operator access opening. A slidable or hinged door may be positioned to cover, or vary the size of, the access opening. Generally, the hood is configured and air vanes are often added, so that air enters the access door and is exhausted through the exhaust opening, with generally laminar airflow being maintained within the chamber to avoid air turbulence that could disturb the materials being manipulated.

Escape of contaminated air from the hood chamber through the access opening into the work environment is prevented by maintaining a pressure differential between the chamber, or hood interior, and the work environment, or hood exterior, so that air continually flows from the hood exterior through the access opening into the hood interior. A sufficient air velocity at the access opening, known as the "face velocity," must be maintained to prevent contaminated air from escaping.

Contaminated air is exhausted from a fume hood through an exhaust conduit that includes a vacuum source to draw the air through the exhaust conduit. Generally, this vacuum source is comprised of an exhaust fan positioned within the conduit, and an electric motor to turn the fan. The gas may be exhausted to the exterior environment when toxic contaminants are not present. In many instances, however, the air will be conveyed through a filter, such as a HEPA filter, to remove contaminants from the air.

When working with hazardous or toxic material, there is frequently a need to transfer portions of the contents of a container into the interior of a fume hood or workstation without releasing any of the contents into the surrounding environment. Some of these containers, which may be carboys, drums, or the like, are quite large and difficult to maneuver. Therefore, placement of one or more of these containers into a fume hood to prevent escape of hazardous materials into the surrounding environment, as well as their subsequent removal, and the insertion or transfer of materials to or from these containers, can be difficult, if not impossible.

In order to address this need, U.S. Pat. No. 6,431,975 to Ryan, issued Aug. 13, 2002, and incorporated herein by reference in its entirety, describes an apparatus and method for transferring hazardous materials between a large container and a fume hood chamber.

Generally, the Ryan apparatus is comprised of an enclosure having walls that define a chamber that includes at least one container-receiving opening in the floor of the enclosure. The enclosure is supported so that a large container having a top opening through which material can be added to, or removed from, can be positioned beneath the enclosure and then raised upwardly, so that the upper section of the container projects through the opening and into the enclosure.

The operator can then open the container from within the enclosure, remove or add material, and then close the container. The container is then lowered to separate the container from the enclosure. As a result, the opening into the container is at all times within the fume hood enclosure when the container is open, thereby preventing hazardous materials from escaping from outside the hood enclosure. As used herein, the term "hazardous" is broadly intended to include all materials, whether in powder, liquid or gaseous form, where escape beyond a confined area is undesirable, and the term "container" is intended to include all containers for such materials.

While the Ryan apparatus is effective in transferring materials without exposing the operator, there is still a need for an apparatus that will achieve this desired result using a fume hood of a more conventional construction, without the need for one or more large holes in the floor of the fume hood.

SUMMARY OF THE INVENTION

Generally, the present apparatus is comprised of an enclosure, preferably a flexible enclosure, having a container access conduit sized to fit over the top of a large container from which material is to be removed, a fume hood conduit sized to fit over a port in the fume hood, and a pair of sleeved gloves extending inwardly into the enclosure from glove ports. The port may be an existing discharge port of the type used to transfer contaminated material from the hood into a bag, or another port used for other purposes or specifically installed for connection to the present apparatus.

Preferably, the enclosure is a flexible, bag-like enclosure with a horizontal diameter at least as large as the top of the hazardous container. The enclosure is preferably constructed of plastic sheet material or other relatively inexpensive, flexible, air impervious material so that the enclosure can be disposed of after use, eliminating the necessity of cleaning the enclosure for reuse. The container conduit is also of a flexible, material and has a circumference at least as great as the top of the container so that the distal end of the container conduit can be inserted over the top of the container. The upper or proximal end of the container conduit is attached about the periphery of an opening into the enclosure.

The present enclosure is primarily adapted for use with a fume hood having a side port of the type often used for disposal of hazardous materials. Such ports are normally inserted into the mouth of a hazardous disposal bag that is secured in an airtight matter around the port. For example, the fume port may include an annular tubular protrusion, with the disposal bag being secured around the protrusion.

It will be understood, however, that the enclosure may be attached to other hood ports, either existing for other purposes, or specifically configured for use with the enclosure. When reference is made herein to a discharge port, it will be understood that the term encompasses all such ports.

In the present invention, the transfer apparatus includes a fume hood conduit that is sized to fit around the fume hood connection port. The fume hood conduit therefore has a circumference at least as large as the circumference of the discharge conduit and an proximal end that is sealed around fume hood conduit opening in the enclosure.

The enclosure also includes a pair of glove ports in the enclosure wall and a pair of sleeved gloves extending into the enclosure for the glove ports. The proximal ends of the sleeves are sealed around the peripheries of the glove ports. The glove ports enable the operator to access the interior of the enclosure and any container attached to the container conduit without exposure to the contents of the container.

The present apparatus also includes a support means mountable above the flexible enclosure to maintain the enclosure in an open configuration. Attachment means on the upper surface of the enclosure are used to secure the enclosure to the frame. For example, the support means can be a pair of parallel rods separated by a width approximately equal to the width of the enclosure, with attachment means insertable onto the rods being positioned adjacent each upper corner of the enclosure.

The apparatus may also include a container lift to position the container for easier operator access to the container contents during removal of portions of the contents. The lift can be designed to raise and lower the container and/or tilt the container toward the operator. The support means can be secured to this lift or to a fume hood into which material is to be placed.

In operation, a container of hazardous material is positioned beneath the enclosure, which is held in a raised position by the support means and attached to the discharge port of a fume hood by the enclosure hood conduit. Hazardous material containers, e.g., drums, usually include a lid and a closed inner bag. The lid is removed from the container and the container conduit is positioned over the upper end of the container. For example, if the container and conduit are tubular, the tubular conduit can be pulled downward over a part of the container, e.g., 25% to 50% of the container. The conduit is then sealed around the container, e.g., with tape or other suitable means.

The operator then reaches into the enclosure through the glove ports, opens the container inner bag, and transfers a portion of the hazardous material into a hazardous material holder, which is placed in the enclosure before the container conduit is sealed or stored in the fume hood and accessible though the glove ports. The filled holder is then inserted into the fume hood through the hood conduit. Once in the fume hood, material is prevented from being discharged into the exterior of the fume hood by the action of the fume hood.

In transferring material from the hood into the container, the above steps are performed in reverse. That is, the operator reaches into the hood to remove hazardous material, which may be in a holder, and extracts the material through the port into the flexible enclosure and then into the container.

If desired, particularly when there is a need to access material near the bottom of the container, the container may be positioned with the lift. After the container is empty or no further material is to be removed, the inner bag is resealed and the hood conduit is sealed. The enclosure can be detached from the support and inserted into the container for reuse or disposal of the enclosure along with the container.

DETAILED DESCRIPTION OF THE PREFERRED EMBODIMENT

Figure 1:
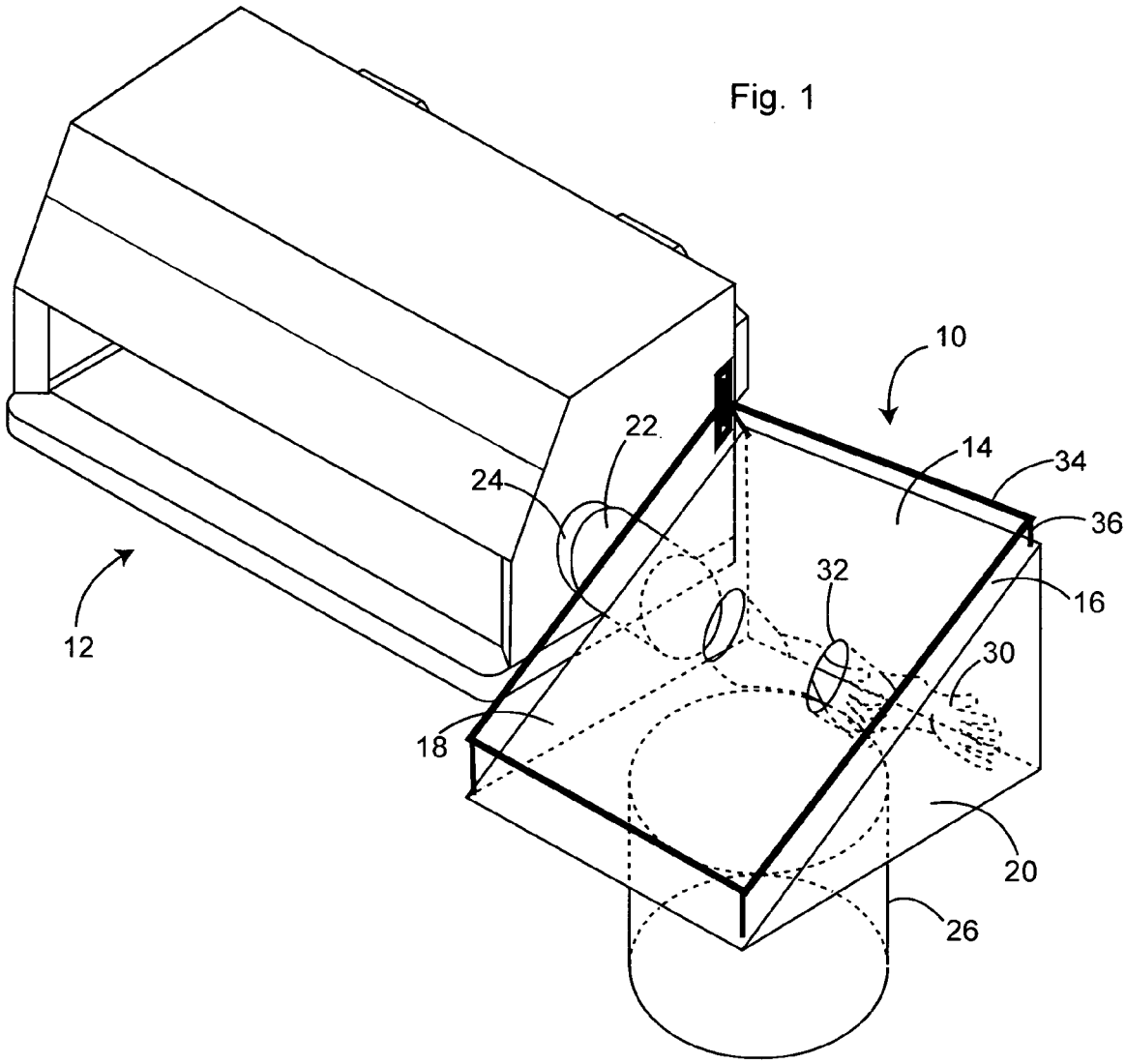
FIG. 1 is perspective view of the present apparatus attached to a fume hood port, showing the apparatus mounted on the fume hood.

As shown in the drawings, which are for purposes of illustration and are not to scale, the present apparatus generally 10, shown in FIG. 1 attached to a fume hood 12, is comprised of a flexible enclosure 14, which includes a rearwardly inclined upper wall 16, a side wall 18 and a bottom wall 20. Fume hood conduit 22 extends from side wall 18 for attachment to port 24 of hood 12 shown extending from a side wall of hood 12, and container conduit 26 extends from bottom wall 20 to fit over the top of large container 28 from which material is to be removed. A pair of sleeved gloves 30 extends into the enclosure from glove ports 32.

Preferably, enclosure 14 is a flexible, bag-like enclosure with a horizontal diameter at least as large as the top of the hazardous container. Enclosure 14, integral conduits 22 and 26, and gloves 30, are constructed of plastic sheet material or other relatively inexpensive, flexible, air impervious material that can be disposed of after use. Container conduit 26 is attached about container 28 with attachment strap 32, which can be of various constructions, including a releasable strap or adhesive tape.

Figure 2:
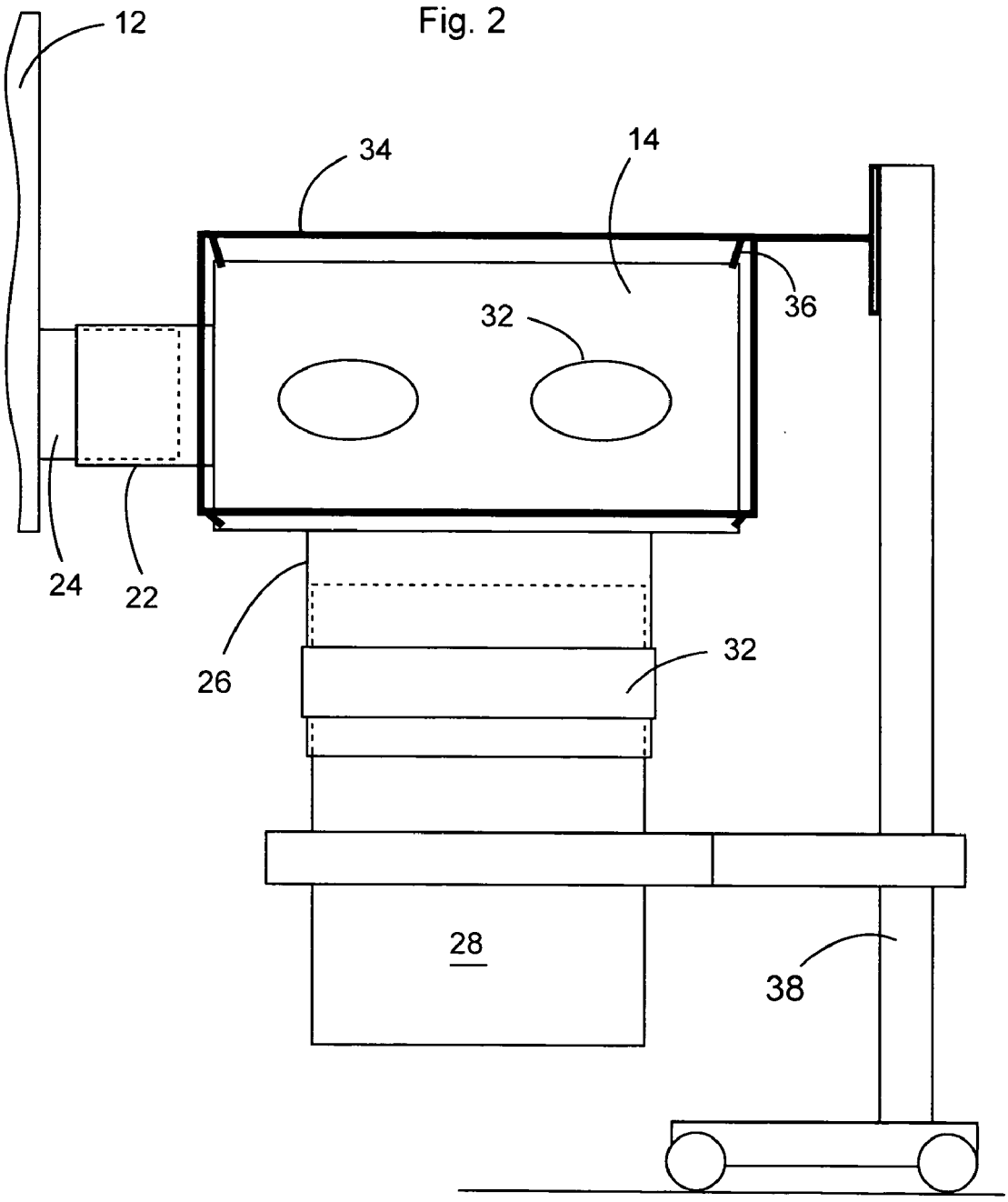
FIG. 2 is a front view of the apparatus attached to a fume hood port and with a container inserted into the container conduit, and showing the apparatus mounted on a lift.

Enclosure 14 is held open and above container 28 by support frame 34, which is attached to the side of hood 12 as shown in FIG. 1, or to lift 38 at a fixed height as shown in FIG. 2. Attachment tabs 36 on the upper surface of enclosure 14 secure enclosure 14 to frame 34. Container 28 is supported on container lift 38, which can be used to raise and lower container 28, during removal of portions of the contents.

In operation, container 28 is positioned beneath enclosure 10 and the lid is removed. Container conduit 26 is pulled downward over the upper part of container 28 and is sealed around container 28 with attachment strap 32. The operator then reaches into enclosure 14 through the glove ports 32 and opens the inner bag in container 28.

A portion of hazardous material can then be transferred from container 28 into a hazardous material holder, not shown, which is then inserted into fume hood 12 through hood port 24, or directly into hood 12. If desired, container 28 can be raised upwardly with lift 38 to facilitate removal of material. After container 28 is empty or no further material is to be removed, the inner bag is resealed and hood conduit 22 is sealed. Enclosure 14 is detached from support 34 and inserted into container 28 for disposal or reuse.

Certain modifications and improvements will occur to those skilled in the art upon reading the foregoing description. It should be understood that such modifications and improvements have been deleted herein for the sake of conciseness and readability but are properly within the scope of the following claims.

What is claimed is:

1. An apparatus for transferring hazardous material from the interior of a container beneath said apparatus into the chamber of a fume hood having a fume hood port comprising:

a) a flexible enclosure with a side wall and a bottom wall;

b) a first conduit extending from the side wall of said enclosure and sized to connect to said port;

c) a second conduit extending downwardly from the bottom wall of said enclosure to connect with a container beneath said enclosure;

d) a pair of glove ports in the enclosure outer wall, including sleeved gloves extending into said enclosure, whereby the interior of said container and the chamber of said fume hood are accessible through said glove ports;

e) a container lift having a raised and lowered position, said lift being attachable to a container beneath said second flexible conduit; and f) an enclosure support above said enclosure, said enclosure including attachment means to releasably attach said enclosure to said support, said enclosure being attached to said lift at a fixed height via said support.

2. The apparatus of claim 1, wherein said enclosure has an upper surface that is inclined toward the rear of the enclosure and said glove ports are in said surface.

3. The apparatus of claim 1, wherein said enclosure upper surface has four corners with attachment means adjacent each of said corners.

4. A system for transferring hazardous material from a container comprising:

a) a fume hood having an interior chamber, a side wall and a port in said side wall in communication with said interior chamber; and b) a transfer apparatus comprising i. a flexible enclosure with upper, side and bottom walls;

ii. a first conduit extending from said enclosure side wall to connect to said port;

iii. a second conduit extending downwardly from said enclosure bottom wall to connect with said container; and iv. a pair of glove ports in the enclosure upper wall, including sleeved gloves extending into said enclosure, whereby the interior of said container and the chamber of said fume hood are accessible through said glove ports;

c) a container lift having a raised and lowered position, said lift being attachable to a container beneath said second flexible conduit; and d) an enclosure support above said enclosure, said enclosure including attachment means to releasably attach said enclosure to said support, said enclosure being attached to said lift with said support.

5. The system of claim 4, wherein said enclosure upper surface is inclined toward the rear of the enclosure.

6. A system for transferring hazardous material from a container comprising:

a) a fume hood having an interior chamber, a rearwardly inclined top wall, a side wall and a port in said side wall in communication with said interior chamber; and b) a transfer apparatus comprising i. a flexible enclosure with upper, side and bottom walls;

ii. a first flexible conduit extending from said enclosure side wall to connect to said port;

iii. a second flexible conduit extending downwardly from said enclosure bottom wall to connect with said container; and iv. a pair of glove ports in the enclosure upper wall, including sleeved gloves extending into said enclosure, whereby the interior of said container and the chamber of said fume hood are accessible through said glove ports;

c) a container lift having a raised and lowered position, said lift being attachable to a container beneath said second flexible conduit; and d) an enclosure support above said enclosure, said enclosure including attachment means to releasably attach said enclosure to said support, said enclosure being attached to said lift with said support.

* * * * *